US008152589B2

(12) United States Patent
Bowen et al.

(10) Patent No.: US 8,152,589 B2
(45) Date of Patent: Apr. 10, 2012

(54) TOY VEHICLE PLAY SET

(75) Inventors: David Scott Bowen, Ft. Collins, CO (US); Kenlip Ong, Singapore (SG); Nicholas Amireh, Los Angeles, CA (US); Joseph Thomas Moll, Mt. Laurel, NJ (US)

(73) Assignee: Mattel, Inc., El Segundo, CA (US)

( * ) Notice: Subject to any disclaimer, the term of this patent is extended or adjusted under 35 U.S.C. 154(b) by 1363 days.

(21) Appl. No.: 11/740,682

(22) Filed: Apr. 26, 2007

(65) Prior Publication Data

US 2008/0057828 A1 Mar. 6, 2008

Related U.S. Application Data

(63) Continuation-in-part of application No. PCT/US2005/038543, filed on Oct. 26, 2005.

(60) Provisional application No. 60/622,043, filed on Oct. 26, 2004.

(51) Int. Cl.
*A63H 30/00* (2006.01)

(52) U.S. Cl. ..... 446/454; 446/175; 446/456

(58) Field of Classification Search ..... 446/454–456, 446/175, 444
See application file for complete search history.

(56) References Cited

U.S. PATENT DOCUMENTS

| | | | |
|---|---|---|---|
| 3,548,539 | A | 12/1970 | Grow |
| 4,266,777 | A | 5/1981 | Ikeda |
| 4,662,854 | A | 5/1987 | Fang |
| 4,810,224 | A | 3/1989 | DeVincent |
| 4,938,483 | A | 7/1990 | Yavetz |
| 4,964,837 | A | 10/1990 | Collier |
| 4,987,349 | A | 1/1991 | Nakamura |
| 5,083,968 | A | 1/1992 | Hart |
| 5,100,153 | A | 3/1992 | Welte |
| 5,100,155 | A | 3/1992 | Lamanna |
| 5,169,156 | A | 12/1992 | Smollar |
| 5,195,920 | A | 3/1993 | Collier |
| 5,397,260 | A | 3/1995 | Tilbor et al. |
| 5,452,901 | A | 9/1995 | Nakada |
| 5,702,107 | A | 12/1997 | Novak |
| 6,071,166 | A | 6/2000 | Lebensfeld et al. |
| 6,224,454 | B1 | 5/2001 | Cheng et al. |
| 6,248,019 | B1 | 6/2001 | Mudie et al. |
| 6,422,945 | B1 | 7/2002 | Okita |
| 6,482,064 | B1 | 11/2002 | Lund |
| 6,491,566 | B2 | 12/2002 | Peters |
| 6,530,841 | B2 | 3/2003 | Bull |

(Continued)

*Primary Examiner* — Dmitry Suhol
*Assistant Examiner* — Alex F. R. P. Rada, II
(74) *Attorney, Agent, or Firm* — Panitch Schwarze Belisario & Nadel LLP

(57) ABSTRACT

A play set comprises master and slave toy vehicles and a stationary base unit. The master toy vehicle includes a radio frequency (RF) receiver to be controlled by a manually operated RF remote control unit and an infrared (IR) transmitter configured to broadcast an IR tracking signal. The slave toy vehicle includes a directional receiver to detect the source of the IR tracking signal and an on-board, self-directing control circuit coupled to the at least one directional receiver to control the slave toy vehicle to chase the master toy vehicle. The base unit includes a platform with a game controller and one or more targets mounted so as to move when struck by the master toy vehicle. The game controller and one or both of the toy vehicles are configured for one way or two way wireless communication between the game controller and toy vehicles(s). The game controller is configured to initiate and control one or more modes of game play through the targets or communication with the toy vehicles.

23 Claims, 6 Drawing Sheets

U.S. PATENT DOCUMENTS 6,699,093 B1 3/2004 Cacciola
6,780,077 B2 8/2004 Baumgartner et al.
6,780,078 B2 8/2004 Hageman
7,568,963 B1 * 8/2009 Atsmon et al. ..... 446/175
7,704,119 B2 * 4/2010 Evans ..... 446/454
2002/0198055 A1 12/2002 Bull et al.
2003/0127801 A1 7/2003 Kerr et al.
2004/0147202 A1 7/2004 Brabrand

* cited by examiner

TOY VEHICLE PLAY SET

CROSS-REFERENCE TO RELATED APPLICATIONS

This application is a continuation-in-part of International Application No. PCT/US2005/038543 filed Oct. 26, 2005, which was published the English language on May 4, 2006 and entitled "TOY VEHICLE PLAY SET", and claims the benefit of U.S. Provisional Patent Application No. 60/622,043 filed Oct. 26, 2004 and entitled "Tipping Tractor RC Vehicles Play Set".

BACKGROUND OF THE INVENTION

U.S. Pat. No. 6,780,077 B2 discloses a toy vehicle combination which includes a first, "master," motorized, chased, remotely controlled toy vehicle and a second, "slave," motorized, chasing, self-directed toy vehicle. Each toy vehicle includes a chassis with a plurality of supporting road wheels, a motive system drivingly coupled to at least one of the plurality of road wheels to propel the chassis and a steering system operably coupled to at least one of the plurality of road wheels to steer the chassis. The master toy vehicle includes a transmitter configured to broadcast infrared (IR) tracking signal, a radio frequency (RF) receiver configured to receive control signals from an RF remote controller, and on-board, master toy vehicle control circuit connected to the receiver and having a first output for controlling the motive system and a second output for controlling the steering system of the master toy vehicle. The slave toy vehicle includes at least one directional receiver configured to receive the IR tracking signal from the transmitter of the master toy vehicle, a control circuit coupled to the at least one directional receiver, first and second outputs of the control circuit connected to the motive system and steering system of the slave toy vehicle or independent motive systems to propel and steer the vehicle. The slave toy vehicle control circuit is configured to control the first and second outputs based upon tracking signals received from the master toy vehicle so as to "chase" and "strike" the master toy vehicle with the slave toy vehicle. The operator attempts to control the movement of the master toy vehicle to prevent it from being caught and struck by the slave toy vehicle.

It is believed that the play value of the above pair of toy vehicles in U.S. Pat. No. 6,780,077 B2 could be improved by providing additional challenges to control the master toy vehicle to while evading the slave toy vehicle.

BRIEF SUMMARY OF THE INVENTION

Briefly stated, the present invention is an improvement in a toy vehicle play set comprising a remotely controlled master toy vehicle and a self-directed slave toy vehicle, wherein the master toy vehicle includes a radio frequency (RF) receiver configured to receive control signals from an RF remote control unit for remote control of the operation of the master toy vehicle. The master toy vehicle also includes a transmitter configured to broadcast at least one tracking signal. The slave toy vehicle includes at least one directional receiver configured to detect the at least one tracking signal from the master toy vehicle and a controller coupled to the at least one directional receiver and configured to control the operation of the slave toy vehicle so as to chase the master toy vehicle. The improvement is a base unit that comprises a platform including at least one target movably secured thereto and configured to move with respect to the base unit by being struck by the master toy vehicle.

In yet another aspect, the invention is an improvement in a toy vehicle play set including a master toy vehicle including a radio frequency (RF) receiver configured to receive control signals from an RF remote control unit for remote control of the operation of the master toy vehicle, the master toy vehicle further including a wireless transmitter configured to broadcast at least a tracking signal, and a slave toy vehicle including at least one directional receiver configured to detect at least the tracking signal and a self directing control circuit coupled to the at least one directional receiver and configured to control the movement of the slave toy vehicle in response to at least the tracking signal detected by the receiver so as to chase the master toy vehicle, an improvement comprising: a stationary base unit having a wireless signal transmitter and a controller configures to generate command signals; and at least one of the master and slave toy vehicles having a wireless signal receiver and on-board control circuit configured to receive and process command signals from the base unit transmitter and to operate the at least one vehicle in response to the command signals.

In another aspect, the invention is an improvement in a toy vehicle play set including a palm-sized, manually operated, portable remote control unit with a plurality of manual actuators, a control circuit responsive to the manual actuators to generate control signals from manipulation of the actuators and a radio frequency transmitter operably connected with the control circuit to transmit wireless radio control signals based upon the manipulations of the manual actuators and a toy vehicle with at least a first electric motor configured to impart movement to the toy vehicle, a radio frequency wireless signal receiver configured to receive wireless radio frequency control signals from the remote control unit and a controller operably connected with at least the radio frequency wireless signal receiver and the first motor, the controller being responsive to the received wireless radio frequency control signals from the remote control unit to control operation of at least the first motor. The improvement comprises a base unit configured for stationary placement and operation on an underlying support surface, the base unit including a control circuit operatively connected to a second wireless signal transmitter operating differently from the radio frequency transmitter of the portable remote control unit, the control circuit further being configured to generate control signals transmitted to the toy vehicle through the second wireless signal transmitter and a power supply operable connected with least the second transmitter and the control of the base unit circuit; and at least a second wireless signal receiver in the toy vehicle configured to receive wireless control signals from the second wireless signal transmitter and further being operably connected with at least the controller to at least partially control operation of the toy vehicle with control signals from the base unit.

The present invention also comprises methods of using the toy vehicle play set described above as a chase game.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings which are diagrammatic.

DETAILED DESCRIPTION OF THE INVENTION

Figure 1:
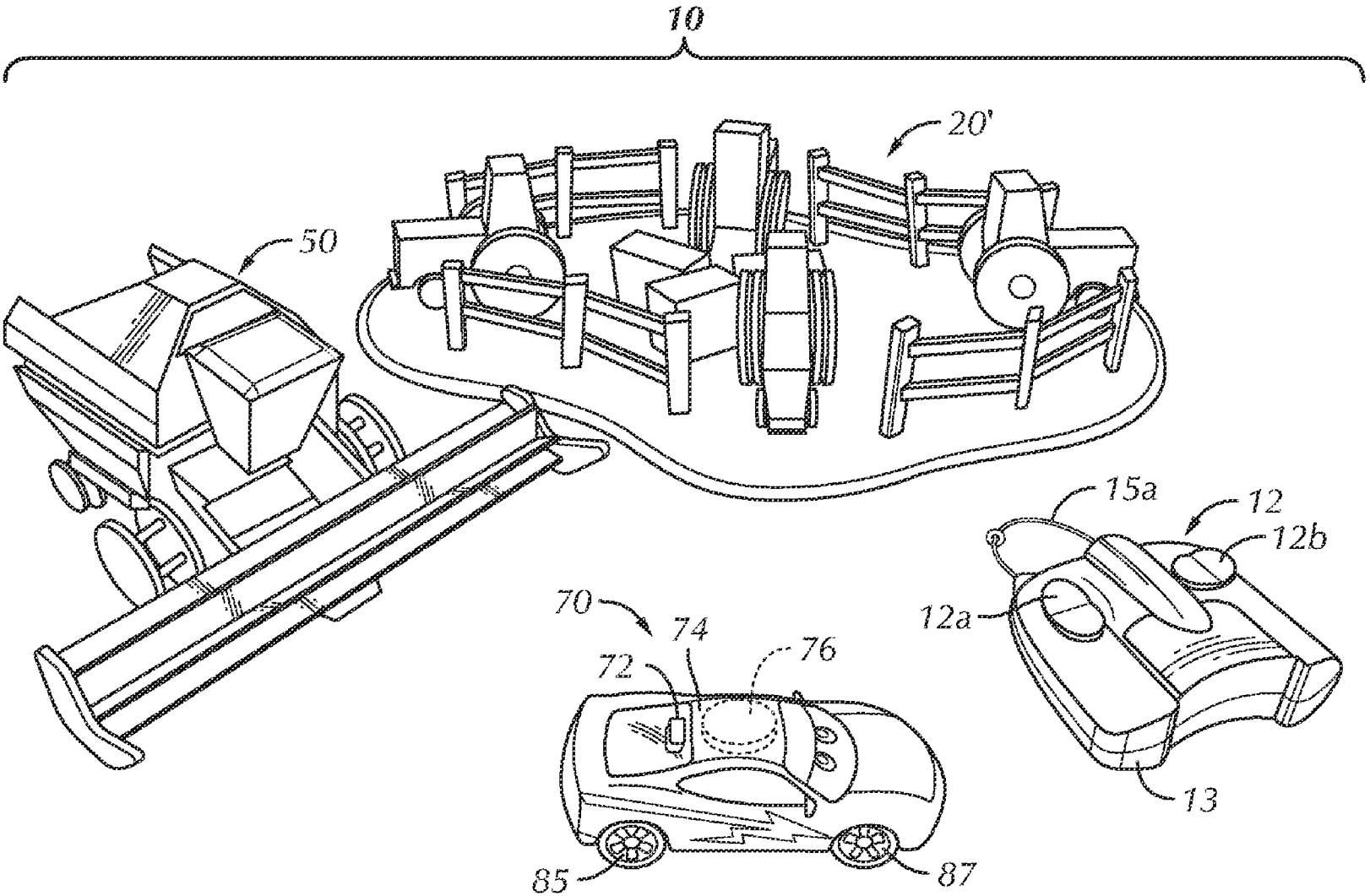
FIG. 1 is a perspective view showing the components of a toy play set of the invention.

Referring to the drawings in detail wherein the same elements are given the same reference numerals throughout the several figures there is shown in FIG. 1 a toy vehicle play set 10 in accordance with a preferred embodiment of the present invention. As shown in FIG. 1, the toy vehicle play set 10 includes a first or "master" toy vehicle 70 in the form of a remotely controlled coupe style toy vehicle, second or a "slave" toy vehicle 50 in the form of a self-directed farm combine style toy vehicle, a conventional, palm-size, manually-operated portable remote control unit 12 and a base unit 20'. Remote control unit 12 includes a palm-size housing 13 mounting a plurality of manual input actuators 12*a*, 12*b* and containing a control circuit 14 operably connected with actuators 12*a*, 12*b* a radio frequency (RF) transmitter. It will be appreciated by those of ordinary skill in the art that the master and slave toy vehicle 70, 50, may take on any other suitable vehicle form including, but not limited to, some other farm vehicle, a truck, such as a pickup truck, a sports car, or virtually any other simulated vehicle. Accordingly, it should be clearly understood that the present invention is not limited to the particular master toy vehicle (coupe 70) or slave toy vehicle (combine 50) as shown and described. The base unit 20' may also take any other form.

Details of the structure and operation of both a master toy vehicle (like 70) and a slave toy vehicle (like combine 50) are set forth in U.S. Pat. No. 6,780,077 B2, the entire disclosure of which is hereby incorporated herein by reference. Briefly, both the coupe 70 and the combine 50 are typical of motorized toy vehicles in that they include a chassis with a plurality of supporting road wheels, a motive system, typically a small battery powered electrical motor, drivingly coupled using gears or the like to at least one of the plurality of road wheels to propel the vehicle in a forward or rearward direction and a steering system, typically another small battery powered electric motor and suitable gearing, operatively coupled to at least one of the plurality of road wheels to steer the vehicle. Alternatively, a pair of motors can be provided separately powering one or more wheels on opposite sides of the vehicle to provide "tank" steering and propulsion. The coupe 70 has an internal, on-board control circuit 84 that includes a conventional radio frequency (RF) receiver (FIG. 5) (with antenna 79*a*) configured to receive signals from the RF remote control unit 12 operated by a person (operator) playing with the toy vehicle play set 10. The RF receiver within the coupe 70 provides received control signals to an on-board control circuit 84 with a controller such as a microcomputer, a microprocessor or an application specific integrated circuit. The on-board control circuit 84 has a first operatively output connected to a motor 81 of a motive system 80, for example, through a conventional motor control circuit 80', operatively connected with a road wheel, rear wheels 85, and a second output operatively connected to the actuator 83 of a steering system 82, for example, through a conventional motor control circuit 82', operatively connected with a different road wheel, front wheel 87, (or to second, independent motive system) to permit the operator to remotely control the movement of the coupe 70 with the unit 12. The coupe 70 further includes at least one transmitter 72, such as an infrared (IR) emitter (or set of such emitters), which is configured to broadcast at least one wireless tracking signal to permit the coupe 70 to be located and chased by the slave combine 50 whenever the two are active.

Unlike the coupe 70, the combine 50 in this embodiment is not controllable by an operator of the toy vehicle play set 10. Instead, the combine 50 is self-directed and includes at least one directional receiver indicated generally at 58 configured to receive the IR (or other type of) tracking signal broadcast from the coupe 70 and an on-board, self-directing control circuit 68 receiving signals from the at least one directional receiver 58. More particularly, the directional receiver 58 preferably includes left and right IR sensors 60*a*, 60*b*, which are located under the roof of the vehicle portion of the combine 50, spaced apart from one another but with fields of view which narrowly overlap directly in front of the combine 50. The sensors 60*a*, 60*b* could be located elsewhere such as behind the "windshields" of the cab, in the headlamps or in the combine (if it is non-rotating). The sensors 60*a*, 60*b* may be operably coupled directly to the self-directing control circuit 68 but preferably are coupled with a detection processor circuit 62, which is part of the preferred directional receiver 58 and is configured to receive output of sensors 60*a*, 60*b* and provide an output (i.e. signal(s)) to the self-directing control circuit 68 in a form that can be used by the self-directing control circuit 68 to control the movement of the combine 50. In this particular case, the self-directing control circuit 68 preferably includes a first output signal for independently controlling a first (i.e. left side) motor 64 of the combine 50 driving at least one left side wheel 65 and a second output signal for controlling a second (i.e. right side) motor 66 of the combine 50 driving at least as a right side wheel 67 in a conventional fashion such as through motor control circuits 64', 66', respectively. In this manner, the combine 50 is independently configured to automatically "chase" the coupe 70 whenever the combine 50 is activated. The self-directing control circuit 68 configured (i.e. programmed) to automatically control the combine 50 in a search mode movement, such as driving forward off the base unit 20 and then turning in tight circles, to search for the tracking signal source when the vehicle 50 initially activates.

Figure 2:
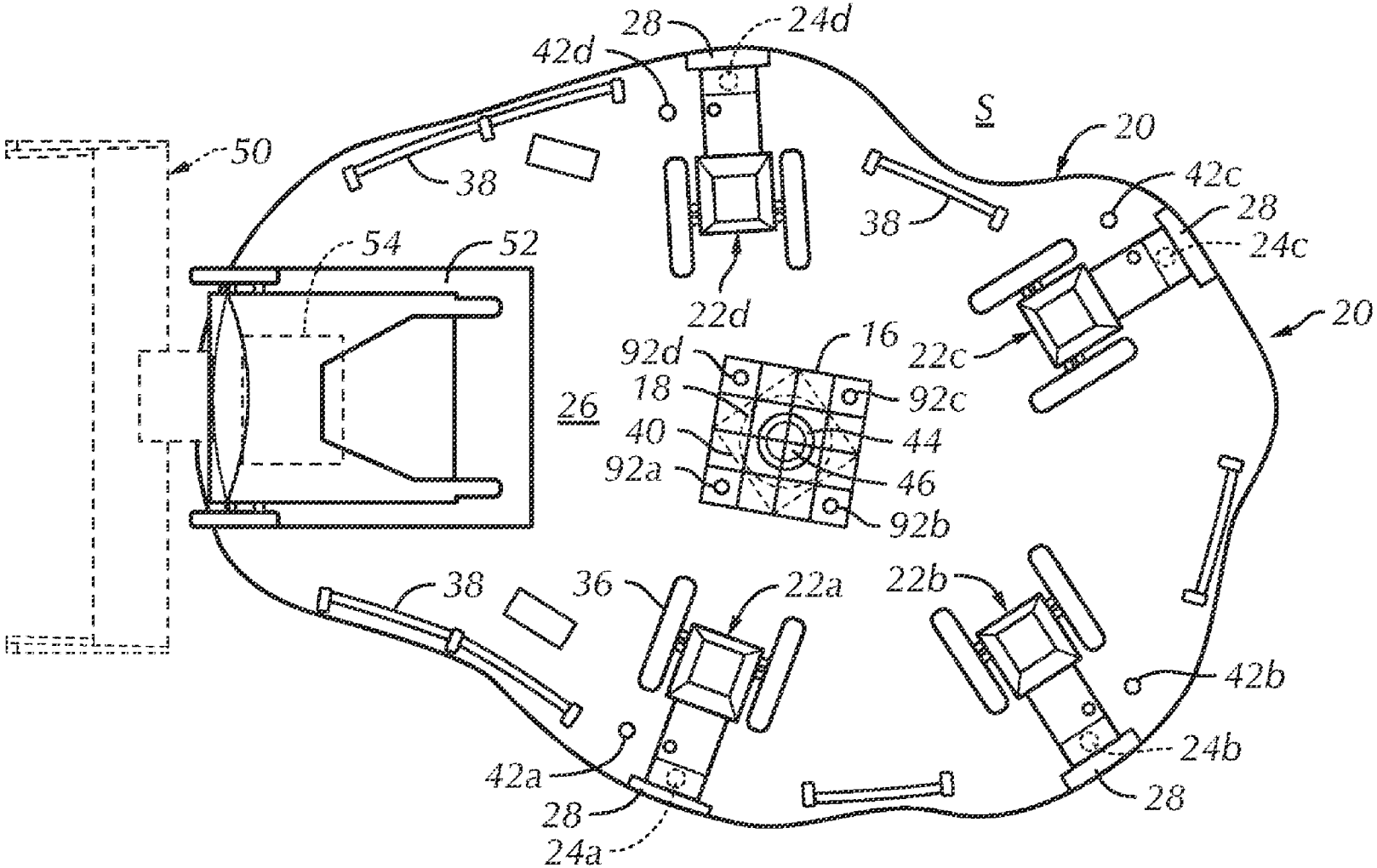
FIG. 2 is a diagrammatic top plan view of a preferred base unit.
Figure 3A:
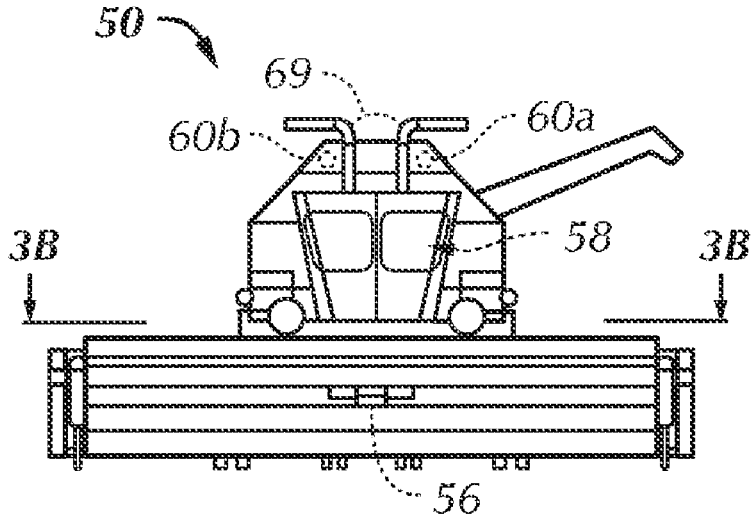
FIGS. 3A, 3B, 3C are front elevation, top section and side section diagrammatic views respectively, of a combine type "slave" toy vehicle.
Figure 3B:
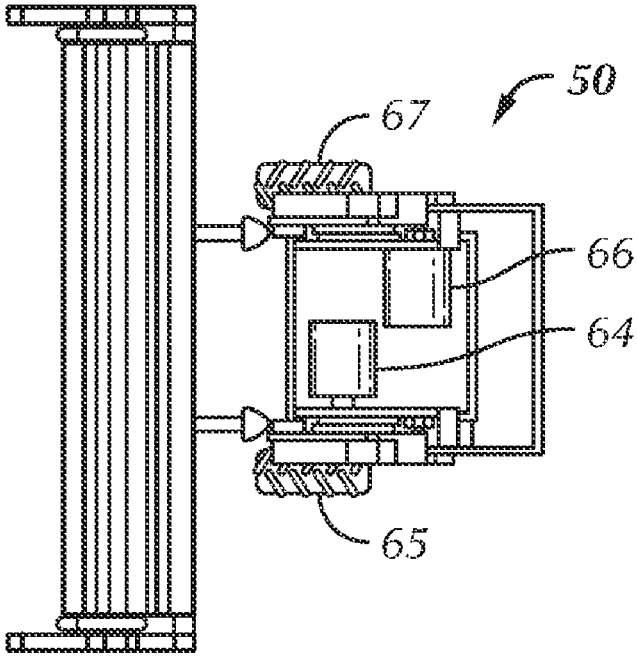
Figure 3C:
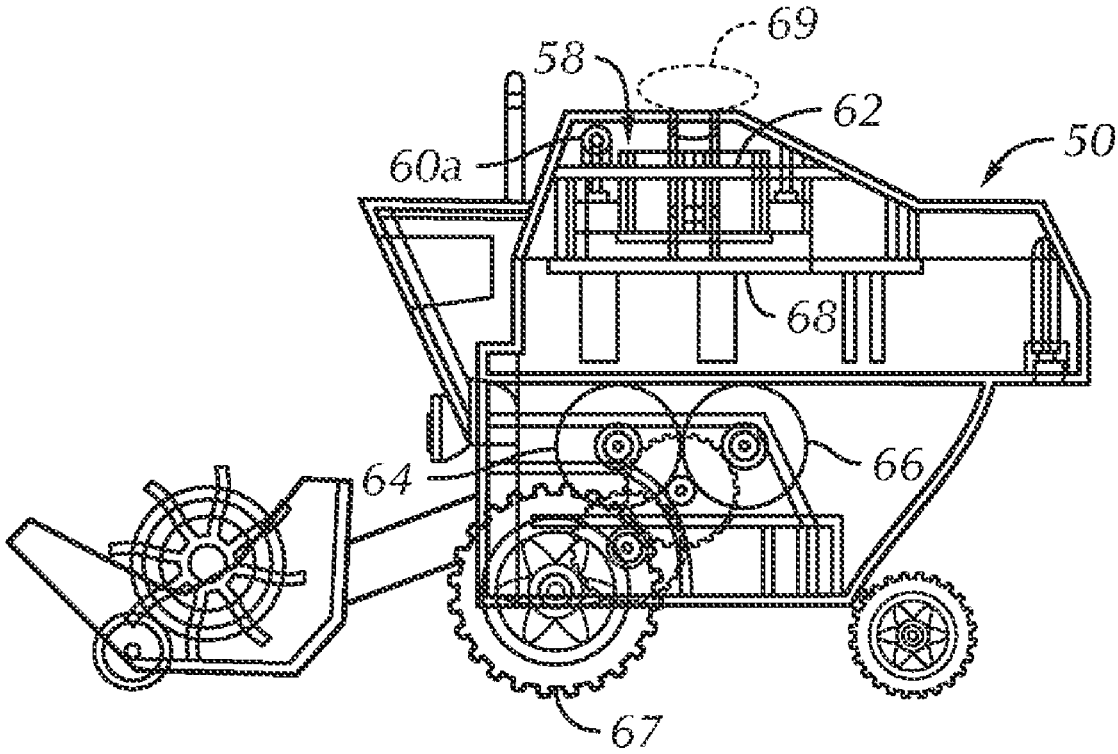

FIG. 2 depicts a preferred base unit 20 which comprises a generally flat, slightly elevated platform 26. Base unit 20 is configured for stationary replacement and operation on an underlying supporting surface (S) such as a table, the floor, or the like. The platform 26 supports at least one and, in the present embodiment, preferably four separate targets 22*a*-22*d* (collectively 22). In the present embodiment, each of the targets 22 includes a toy farm tractor. However, the targets 22 may take on any other suitable form such as some other type of farm vehicle, some other type of vehicle, or something else. Accordingly, the present invention is not limited to four targets or to targets in the form of a tractor.

As shown in FIGS. 1 and 2, the tractors 22 are positioned at spaced locations along the periphery of the platform 26 with the front ends of the tractors 22 facing outwardly. A plurality of fence members 38 are located on the periphery of the platform 26 between the tractors 22. In this manner, the front ends of each of the tractors 22 are exposed along the outer surface of the platform 26 between the fence members 38. An additional space 52 is provided between two of the fence members 38 of base unit 20 in FIG. 2 to permit the combine 50 to be parked on a home position 52 portion of the platform 26.

Figure 4:
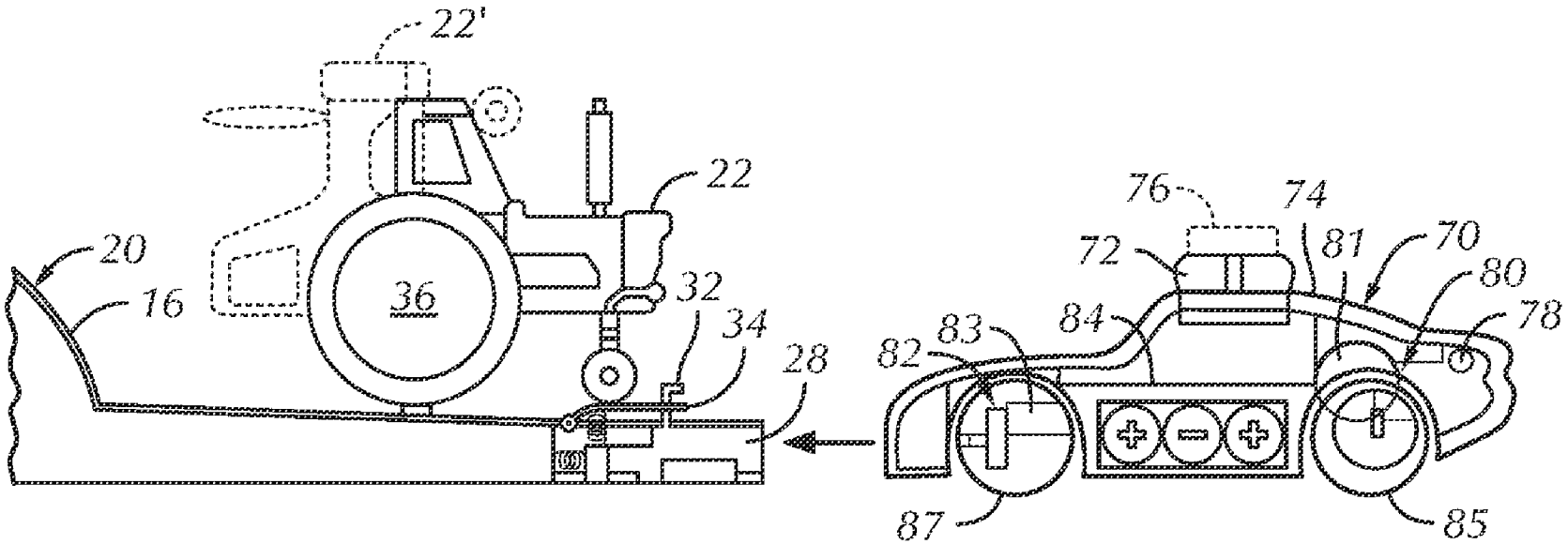
FIG. 4 is a diagrammatic side elevational section view illustrating the master toy vehicle of FIG. 1 striking one of the targets of the base unit of FIG. 1 or FIG. 2.

As shown in FIGS. 1, 2 and 4, the tractors 22 normally assume a first, upright position shown in solid. The tractors 22 are also capable of assuming a second or overturned position as shown in phantom at 22' in FIG. 4 when the front end of any tractor is struck by the coupe 70. Referring to FIG. 4, in the present embodiment, a spring-loaded actuator 34 is preferably positioned within the platform 26 proximate to the front end of each of the tractors 22. Each spring-loaded actuator 34 biases its associated tractor 22 to pivot about its rear wheels 36 toward the second or overturned position indicated in phantom at 22' in FIG. 4. A latch member 32 is provided for holding the associated tractor 22 against the bias of the spring-loaded actuator 34 in the first, upright position. A contact or release member 28 (preferably spring loaded) is associated with each latch member 32 for releasing the latch member 32 when the release member 28 is struck by the coupe 70. As will be understood by those of ordinary skill in the art, when the release member 28 is struck by the coupe 70, the latch member 32 is released, thereby enabling the bias of the spring-loaded actuator 34 to move the associated tractor 22 from the first, upright position (solid in FIGS. 1, 2 and 4) to the second, overturned position (in phantom in FIG. 4 at 22').

Each base unit 20, 20' further includes a game controller. As best seen in FIG. 2, a game controller is indicated diagrammatically at 40 and is configured to control the operation of one or more chase games or modes of play which may be played using the above-described toy vehicle play set 10. The game controller 40 preferably receives signals through the platform 26 from sensors 24*a*-24*d* (collectively 24) each located on the platform and associated with one tractor 22*a*-22*d*, respectively, its actuator 34, latch 32 and/or contact lever 28, to indicate the position or orientation of each tractor 22 (i.e., whether each tractor 22 is in the first, upright position or in the second, overturned position 22'). Preferably, a first visual indicator, in the present embodiment a switch-controlled, light-emitting diode (LED) 42*a*-42*d* (42 collectively), is located proximate to each of the tractors 22*a*-22*d*, respectively, for indicating the current position of the associated tractor 22 or as part of the game play. LED's 42 can be controlled in different ways, for example, directly by sensor 24 or indirectly by the game controller 40. Preferably, the game controller 40 is preferably located in a central housing 16 which further includes four additional light-emitting diodes (LEDs) 92*a*-92*d* (collectively 92) and a speaker 18. The LED's 92 when lit can indicate a particular tractor 22 which is overturned (indicated diagrammatically in phantom at 22') or is to be overturned in conjunction with the playing of a game hereinafter described. Preferably, another sensor 54 (indicated diagrammatically in phantom in FIG. 2) such as a contact or pressure switch or magnetic proximity switch or a light emitter and detector pair (neither shown) is provided within the platform 26 to confirm to the game controller 40 that the combine 50 is parked at the home position 52 on the platform 26.

In the present embodiment, the game controller 40 is microprocessor-based and includes memory (not shown) which contains an operating program and programmed commands for a plurality of different games which may be played utilizing the toy vehicle play set 10. Game controller 40 further includes at least a microcomputer or microprocessor or the processor portion of a sound synthesizer chip or an application specific integrated circuit, to run the operating program, generate control signals and respond to signals it receives. Preferably, a game to be played may be selected by an operator utilizing one or more control switches (not shown) if provided on central housing 16 or elsewhere on the base unit 20, or remotely, for example, utilizing the remote control unit 12 for the master vehicle (coupe) 70.

According to another aspect of the invention, the coupe 70 and/or combine 50 may include a receiver or transceiver for communicating with the game controller 40 of the base unit 20. For example, the base unit 20 can be provided with a wireless IR signal transmitter (emitter) 44 using LED 44*a*, capable of transmitting either on a different wavelength from that of the IR tracking signal broadcast by the coupe 70, but still detectable by the directional receiver 58 and its IR sensors 60*a*, 60*b*, or on the same bandwidth but modulated at a much different frequency so as to pass information to the combine 50. The on-board, self-directing control circuit 68 of the combine 50 is then configured to identify and decode the information in the base unit signal. For example, under control of the game controller 40, the base unit 20 could emit a continuous IR signal for a significant time period (e.g. 3-5 seconds) to signal the end of a game. Alternatively, the base unit 20 could transmit other commands based on game play that cause operating characteristics (e.g., top speed) of the self-directing control circuit 68 changed. The coupe 70 can also be provided with a IR receiver 76 with sensor 76*a*, for example, in phantom above its emitter 72, to detect and decode the same signal(s) transmitted/emitted by the base unit 20. Similarly, the on-board control circuit 84 of the couple 70 has a processor configured (i.e. programmed) to decode commands from the user's remote control unit 12. This circuit 84 can also be configured to vary the IR tracking signal it broadcasts in order to communicate with the base unit 20. For example, the coupe 70 could broadcast a differently modulated signal to indicate when it is being struck by the combine or when it has been struck a selected or predetermined number of times. The base unit 20 can be provided with an appropriate (i.e. IR) receiver 46 with sensor 46*a* to receive such signals for decoding by the game controller 40. Alternatively, the combine 50 can be provided with its own IR transmitter 69 (in phantom with LED 69*a*) to broadcast a signal when it has struck the coupe 70 or other object. Both vehicles 70, 50 can be provided with transmitters configured to broadcast a contract/collision signal. The base unit 20 can then determine if a vehicle to vehicle contact has occurred by concurrent signals from both vehicles 70, 50. Alternatively, one vehicle (e.g. the coupe 70) can be the designated transmitter and other means, for example, a magnetic proximity coil 78 on the one vehicle 70 capable of sensing another coil 56 on the remaining vehicle 50, in contact with the rear of the one vehicle 70, can be used for indirect vehicle to vehicle contact confirmation. The coils 56, 78 can also be used with an appropriate magnetic type sensor 54 in the home position 52 of the base unit 20.

Figure 5:
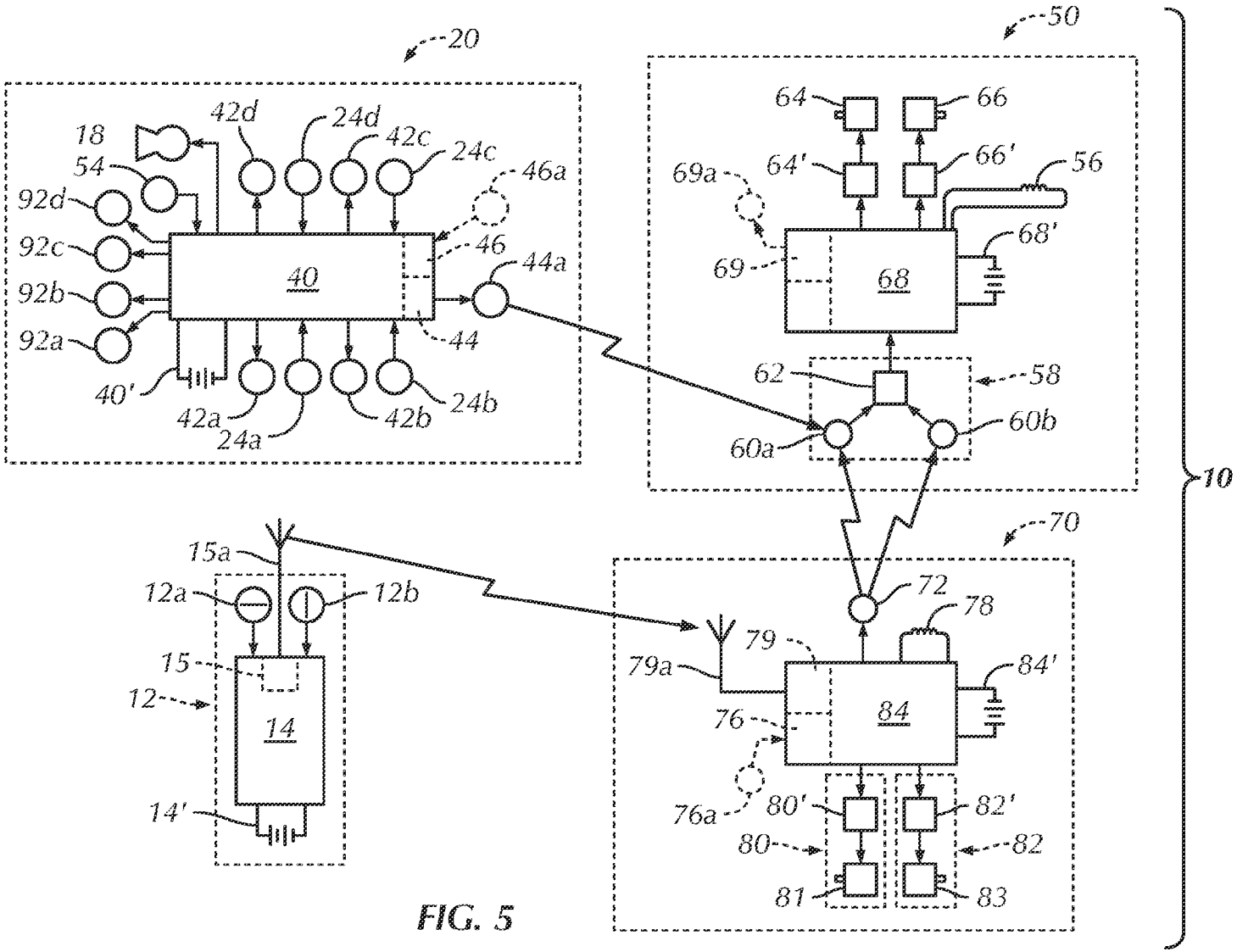
FIG. 5 is a very schematic representation of the various electrical components of each device 12, 20, 50, 70 of the play set 10.

The above-identified electrical components of each of the elements 12, 20/20', 50 and 70 of the toy play set 10 are again shown in FIG. 5. It is noted that each element 12, 20/20', 50 and 70 is provided with its own power supply 14', 40', 68' and 84', respectively. Preferably all power supplies are batteries, disposable or, more preferably, rechargeable. It will be appreciate that because the base unit is stationary, it can be powered via a transformer from a conventional AC household power source. However, the power supply cord may interfere with play.

The above-identified toy vehicle play set 10 may be used for playing many different games as well as variations thereof. Described below are several preferred games and variations thereof. It should be clearly understood by those skilled in the art that the toy vehicle play set 10 may also be employed for playing games other than those described below and that the elements of the play set can be modified as described above or as follows for different operation and play.

In a first game or mode of play, the combine 50 is parked on the space 52 of the platform 26 and is initially in an inactive condition. When the game begins, the game controller 40 establishes a predetermined period of time during which the coupe 70 is maneuvered by the operator to attempt to strike and overturn each of the tractors 22, preferably while the combine 50 is inoperable. If configured that way, the controller 40 can sense the presence of the combine 50 on the parking space 52 of the platform 26 by the sensor 54. The first predetermined period of time during which the combine 50 remains inoperable or inactive may vary under the control of the game controller 40. The game controller 40 stops the game and declares the coupe 70 as a winner as soon as the coupe 70 has struck and overturned all of the tractors 22. The game controller 40 knows the position/orientation of each tractor 22 because of the status of the sensor 24 in or on the platform 26 that is associated with the tractor 22. Upon the expiration of the first predetermined period of time, if all of the tractors 22 have not been overturned, the game controller 40 can broadcast an IR signal which activates the combine 50. The combine 50 then automatically seeks out and attempts to make contact with the coupe 70 during a second time period established by the game controller 40. If the combine 50 makes contact with the coupe 70 once or a predetermined number of times, which is established by the controller 40, the controller 40 declares the combine 50 the winner and can stop the game by deactivating the combine 50. If the second time period has expired and the combine 50 has not contacted the coupe 70 the predetermined number of times or if the coupe 70 has contacted and overturned all of the tractors 22, the controller 40 can declare the coupe 70 the winner and stop the game as indicated above. The game controller 40 can signal either or both vehicles to initiate a sequence of sound effects to signify the coupe victory. For example, the coupe 70 may be configured to receive and process wireless control signals from the base unit transmitter and perform a special preprogrammed stunt movement or provide a light and/or sound effect or both. The combine may perform a preprogrammed set of movements in response to the same signal or be rendered inactive while the coupe continues to operate as a variation upon the first game. The play set may be configured so the combine 50 need not begin the game on the park space 52 of the platform 26.

In a second game or mode of play, the combine 50 is initially parked on the space 52 of the platform 26 and is inactive. When the game begins, the game controller 40 establishes a first predetermined period of time (which may be varied automatically by programming or by user selection) during which the coupe 70 may attempt to strike and overturn the tractors 22 and during which the combine 50 is inoperable. In this second game or mode of play, the game controller 40 illuminates the tractor identification LEDs 42*a*-42*d* to establish a predetermined order in which the coupe 70 must strike and overturn the tractors 22*a*-22*d*. The combine 50 may be released by the game controller 40 if a tractor 22 is struck and overturned by the coupe 70 out of the established order. Alternatively or in addition, the game controller 40 may release the combine 50 if an identified tractor 22 is not struck and overturned by the coupe 70 within a third predetermined time period established by the game controller 40. If the coupe 70 engages and tips over all four of the tractors 22 in the correct order and/or within the established third predetermined time period for each, the game controller 40 can declare the coupe 70 as the winner. Of course, if the combine 50 is activated and makes contact with the coupe 70 or contact the requisite predetermined number of times during the second time period, then the game controller 40 can stop the game and declare the combine 50 the winner. If the second predetermined time period has expired and the combine 50 has not made contact with the coupe 70 or contact the requisite number of times, then the game controller 40 can stop the game and the coupe 70 declared the winner. If the game controller 40 is further configured for communication with the coupe 70 it can signal the end of the game to either or both vehicles and initiate a response or one of several responses or a selected one of several responses by the combine 50 and/or coupe 70, depending upon the outcome of the game.

As a third game or mode of play, the coupe 70 and combine 50 can be configured to play with one another without any interaction with the base unit tractors 22. The game controller 40 may establish a predetermined time period after which the combine 50 is activated to chase after the coupe 70. If the combine 50 does not catch and strike the coupe 70 a predetermined number of times as established by the game controller 40 and within a second predetermined period of time established by the game controller 40 then the game controller 40 signals the end of the game and the coupe 70 is declared the winner. A victory celebration of the type described above may then be initiated by the game controller 40.

It will be appreciated by those skilled in the art that changes could be made to the embodiments described above without departing from the broad inventive concept thereof. For example, the base unit can be provided with any other wireless control signal transmitter operating differently from the transmitter of the manually operated remote control unit 12. The other ("second") transmitter of the base unit can even be a radio transmitter operating at a carrier frequency or ("frequencies") different from that of the manually operated remote control unit 12, or even at the same frequency with a different set of command codes or coded control signals. Either or both vehicles 50, 70, would be provided with a wireless signal receiver and configured to respond to control signals received from this other (second) transmitter for separate and independent control of either or both toy vehicle(s) by the base unit as well as wireless control on one toy vehicle by the manually operated control unit 12.

The base unit can be equipped with at least a receiver in addition to, or a transceiver instead of, just a transmitter, so that the base unit can communicate with either or both toy vehicles. Either or both toy vehicles would then be equipped with at least a receiver and transmitter (or a transceiver) so as to be configured for two-way communication with the base unit.

Each element 12, 20, 50 and 70 includes some form of control circuit, which is conventionally and preferably embodied, at least in part, by a software or firmware driven, commercially available microprocessor but control might alternatively be provided through an Application Specific Integrated Circuit or a binary element or analog element circuit.

It is understood, therefore, that this invention is not limited to the particular embodiments disclosed, but it is intended to cover modifications within the spirit and scope of the present invention as defined by the appended claims.

We claim:

1. In a toy vehicle play set including a master toy vehicle including a radio frequency (RF) receiver configured to receive control signals from an RF remote control unit for remote control of the operation of the master toy vehicle, the master toy vehicle further including a wireless transmitter configured to broadcast at least a tracking signal, and a slave toy vehicle including at least one directional receiver configured to detect at least the tracking signal and a self-directing control circuit coupled to the at least one directional receiver and configured to control the movement of the slave toy vehicle in response to at least the tracking signal detected by the receiver so as to chase the master toy vehicle, an improvement comprising:

a stationary base unit having a wireless signal transmitter and a programmed game controller configured to autonomously generate command signals broadcast through the wireless signal transmitter; and at least one of the master and slave toy vehicles having a wireless signal receiver and on-board control circuit configured to receive and process command signals from the base unit transmitter and to operate the at least one vehicle under the autonomous control of the base unit in response to the command signals; and wherein the slave toy vehicle has the wireless signal receiver and wherein the master toy vehicle has a second wireless signal receiver and an on-board control circuit configured to receive and process command signals from the base unit transmitter as well as control signals from the remote control unit and to operate the master toy vehicle in response to the command signals and the control signals.

2. At least one of the master and slave toy vehicles further including a wireless signal transmitter and the toy play set of claim 1 wherein the base unit includes a wireless signal receiver configured to receive signal transmissions from the at least one vehicle wireless signal transmitter and the game controller being configured to respond to the wireless signals from at least one vehicle wireless signal transmitter.

3. The toy play set of claim 2 wherein a remaining one of the master and slave toy vehicles includes a transmitter configured for wireless communication with the base unit through the base unit wireless signal receiver.

4. In a toy vehicle play set including a palm-sized, manually operated, portable remote control unit with a plurality of manual actuators, a control circuit responsive to the manual actuators to generate control signals from manipulation of the actuators and a radio frequency transmitter operably connected with the control circuit to transmit wireless radio control signals based upon the manipulations of the manual actuators and a toy vehicle with at least a first electric motor configured to impart movement to the toy vehicle, a radio frequency wireless signal receiver configured to receive wireless radio frequency control signals from the remote control unit and a controller operably connected with at least the radio frequency wireless signal receiver and the first motor, the controller being responsive to the received wireless radio frequency control signals from the remote control unit to control operation of at least the first motor, an improvement comprising:

a base unit configured for stationary placement and operation on an underlying support surface, the base unit including a control circuit operatively connected to a second wireless signal transmitter operating differently from the radio frequency transmitter of the portable remote control unit, the control circuit further being configured to generate control signals transmitted to the toy vehicle through the second wireless signal transmitter and a power supply operably connected with least the second transmitter and the control of the base unit circuit; and at least a second wireless signal receiver in the toy vehicle configured to receive wireless control signals from the second wireless signal transmitter and further being operably connected with at least the controller to at least partially control operation of the toy vehicle with control signals from the base unit.

5. The toy vehicle play set of claim 4 wherein the toy vehicle is a first toy vehicle of the play set and further includes a wireless transmitter configured to broadcast a tracking signal, and wherein the play set further includes a second, motorized toy vehicle having at least one directional receiver configured to detect the tracking signal and a self-directing control circuit coupled to the at least one directional receiver and configured to control the movement of the second toy vehicle in response to the tracking signal of the first toy vehicle to automatically chase the first toy vehicle; and wherein the improvement further comprises the control circuit of the base unit being programmed to autonomously generate command signals broadcast through the second wireless signal transmitter and a second receiver on the second toy vehicle configured to receive and respond to command signals from the second wireless transmitter of the base unit whereby the self-directing control circuit of the second toy vehicle is also controlled by the control circuit of the base unit.

6. The toy vehicle play set of claim 5 wherein the base unit control circuit includes a programmed game controller further configured to control interaction of the first and second toy vehicles for game play.

7. The toy vehicle play set of claim 6 wherein the base unit game controller is further configured so as to control at least one of activation of the second toy vehicle and deactivation of the second toy vehicle.

8. The toy vehicle play set of claim 7 wherein the base unit game controller is further configured so as to control both activation of the second toy vehicle and deactivation of the second toy vehicle.

9. The toy vehicle play set of claim 5 wherein the base unit control circuit is further configured to sense physical contact of at least one of the first and second toy vehicles with the base unit.

10. The toy vehicle play set of claim 4 wherein the base unit comprises a platform configured for stationary placement and operation with at least one target movably secured thereto, the target being configured to move from a first position with respect to the platform to a second position with respect the platform at least by being struck by the toy vehicle; and wherein the base unit control circuit is operatively coupled with the at least one target movably secured to the platform so as to monitor the target being moved.

11. The toy vehicle play set of claim 10 further including a spring-loaded actuator member configured to bias the target toward the second position, a latch member configured to hold the target in the first position against the bias of the spring-loaded actuator and a release member operably connected with the latch member so as to release the latch member from the actuator member by being struck by the toy vehicle so that the spring-loaded actuator moves the target to the second position.

12. A toy vehicle play set comprising:

a master toy vehicle including a radio frequency (RF) receiver configured to receive control signals from a manually operated, portable remote control unit with RF transmitter configured for remote control of the operation of the master toy vehicle, the manually operated, portable remote control unit configured for operator remote control operation of the master toy vehicle, the master toy vehicle further including a wireless transmitter configured to broadcast at least a tracking signal, a slave toy vehicle including at least one directional receiver configured to detect at least the tracking signal and a self-directing control circuit coupled to the at least one directional receiver and configured to control the movement of the slave toy vehicle in response to at least the tracking signal detected by the at least one directional receiver so as to automatically follow the master toy vehicle, and a stationary base unit separate from and in addition to the manually-operated, portable, remote control unit, the stationary base unit having a wireless signal transmitter and a programmed game controller configured to autonomously generate command signals broadcast through the wireless signal transmitter;

wherein at least one of the master and slave toy vehicles has a wireless signal receiver and an on-board control circuit configured to receive and process command signals from the stationary base unit transmitter and to operate the at least one vehicle under the autonomous control of the base unit in response to the command signals;

wherein the slave toy vehicle has the wireless signal receiver; and wherein the master toy vehicle has a second wireless signal receiver and an on-board control circuit configured to receive and process command signals from the base unit transmitter as well as control signals from the remote control unit and to operate the master toy vehicle in response to the command signals and the control signals.

13. At least one of the master and slave toy vehicles further including a wireless signal transmitter and the toy play set of claim 12 wherein the base unit includes a wireless signal receiver configured to receive a signal transmissions from at least one vehicle transmitter and the game controller further being configured to respond to the wireless signals from at least one vehicle transmitter.

14. The toy play set of claim 11 wherein a remaining one of the master and slave toy vehicles includes a transmitter configured for wireless communication with the base unit through the base unit wireless signal receiver.

15. The toy vehicle play set of claim 12 wherein the stationary base unit includes a stationary platform with a plurality of targets, each of the plurality of targets being configured to move from a first position with respect to the platform to a second position with respect the platform in response to being struck by a toy vehicle, and with a plurality of sensors, each sensor being operatively coupled with the game controller and a separate one of the plurality of targets to signal a position of the associated target to the game controller, the game controller further being configured to monitor position of each of the plurality of targets.

16. The toy vehicle play set of claim 15 wherein the game controller is further configured to:

establish a first predetermined period of time during which the master toy vehicle may attempt to strike and move the plurality of targets while the slave toy vehicle is inoperable; and transmit a control signal to the slave toy vehicle upon expiration of the first predetermined time period to activate the slave toy vehicle to seek out and make contact with the master toy vehicle if the plurality of targets are not all struck and moved during the first predetermined time period.

17. The toy vehicle play set of claim 16 wherein the game controller is further configured to establish a predetermined order in which the master toy vehicle must strike and move the plurality of targets and wherein the base unit further includes a separate visual indicator on the platform associated with each target monitored by the game controller and operatively coupled with the game controller so as to be used by the game controller to identify a particular one of the targets to be struck by the master toy vehicle.

18. The toy vehicle play set of claim 17 wherein the game controller is further configured to transmit the control signal to activate the slave toy vehicle before the expiration of the first predetermined time period after one of the plurality of targets is struck and moved out of the established predetermined order.

19. The toy vehicle play set of claim 18 wherein the game controller is further configured to transmit the control signal to activate the slave toy vehicle before the expiration of the first predetermined time period when one of the targets is not struck in the predetermined order within another predetermined time period established by the game controller within the first predetermined time period.

20. The toy vehicle play set of claim 15 wherein:

at least one of the master and slave toy vehicles includes an on-board sensor configured to sense contact with a remaining one of the master and slave toy vehicles, and a wireless signal transmitter operably coupled with the sensor to broadcast wireless signals relating to vehicle contact sensed by the sensor; and the base unit further comprises a wireless signal receiver configured to receive and pass to the game controller, the wireless signals relating to the sensed vehicle contact.

21. The toy vehicle play set of claim 20 wherein the game controller is further configured to transmit a signal indicating end of a game upon the earliest occurrence of (1) the master toy vehicle striking and moving all of the plurality of targets, (2) the slave toy vehicle making contact with the master toy vehicle a predetermined number of times, and (3) expiration of a second predetermined time period established by the game controller to follow the first predetermined time period.

22. The toy vehicle play of claim 12 wherein at least one of the master and slave toy vehicles further includes a transmitter configured to broadcast a wireless signal and the base unit is configured to receive wireless signal transmissions from at least one vehicle transmitter and to pass the received wireless signals to the game controller.

23. The toy vehicle play of claim 12 wherein each of the master and slave toy vehicles further includes a transmitter configured to broadcast a wireless signal and the base unit is configured to receive wireless signal transmissions from either of the master and slave toy vehicles transmitters and to pass the received wireless signals to the game controller.

* * * * *